US006401941B1

(12) United States Patent
Maumus

(10) Patent No.: US 6,401,941 B1
(45) Date of Patent: Jun. 11, 2002

(54) RACK FOR LOADING PARTS FOR HEAT TREATMENT

(75) Inventor: Jean-Pierre Maumus, Saint Medard en Jalles (FR)

(73) Assignee: Societe Nationale d'Etude et de Construction de Moteurs d'Aviation S.N.E.C.M.A., Paris (FR)

( * ) Notice: Subject to any disclaimer, the term of this patent is extended or adjusted under 35 U.S.C. 154(b) by 0 days.

(21) Appl. No.: 09/743,087

(22) PCT Filed: May 4, 2000

(86) PCT No.: PCT/FR00/01206

§ 371 (c)(1),
(2), (4) Date: Jan. 4, 2001

(87) PCT Pub. No.: WO00/68626

PCT Pub. Date: Nov. 16, 2000

(30) Foreign Application Priority Data

May 5, 1999 (FR) ..... 99 05692

(51) Int. Cl.[7] ..... A47F 5/00

(52) U.S. Cl. ..... 211/59.1; 211/193; 211/13.1; 148/586

(58) Field of Search ..... 211/59.1, 193, 211/13.1; 148/586, 581, 589

(56) References Cited

U.S. PATENT DOCUMENTS

| | | | | |
|---|---|---|---|---|
| 1,813,085 A | | 7/1931 | Rowland | |
| 3,388,806 A | * | 6/1968 | Cunningham et al. | |
| 3,858,827 A | * | 1/1975 | Glassbrook | |
| 4,501,369 A | * | 2/1985 | Fox | 211/59.1 X |
| 4,679,510 A | * | 7/1987 | Veyhl et al. | |
| 5,186,764 A | | 2/1993 | Stiasny | |
| 5,667,603 A | | 9/1997 | Ichikawa et al. | |
| 5,688,098 A | * | 11/1997 | Theno | 211/59.1 |
| 5,894,946 A | * | 4/1999 | Darnell et al. | 211/193 |
| 6,119,875 A | * | 9/2000 | Smith | 211/59.1 |
| 6,129,224 A | * | 10/2000 | Mingers | 211/193 |

FOREIGN PATENT DOCUMENTS

| | | |
|---|---|---|
| DE | 15 58 553 A | 3/1970 |
| DE | 30 20 888 A1 | 12/1981 |
| DE | 43 41 648 C1 | 1/1995 |
| DE | 297 21 475 U1 | 2/1998 |
| EP | 0 518 746 A1 | 12/1992 |

* cited by examiner

*Primary Examiner*—Robert W. Gibson, Jr.
(74) *Attorney, Agent, or Firm*—Weingarten, Schurgin, Gagnebin & Lebovici LLP

(57) ABSTRACT

The rack is made essentially out of thermostructural composite material and comprises a baseplate (12), a partition (14) extending above the baseplate, and a plurality of support arms (20) fixed to the partition and extending substantially horizontally therefrom to their own free ends, so that parts to be treated (A) can be supported in cantilevered-out positions on said arms.

9 Claims, 3 Drawing Sheets

RACK FOR LOADING PARTS FOR HEAT TREATMENT

FIELD OF THE INVENTION

The invention relates to a rack or tooling for supporting parts in a heat treatment furnace.

A particular but non-exclusive field of application of the invention is that of tooling for supporting parts in a cementation furnace.

BACKGROUND OF THE INVENTION

In the above field, the tooling most commonly used is made of metal. It suffers from the following main drawbacks:

- the tooling is itself subjected to cementation and rapidly becomes brittle, which can give rise to a large amount of disorder in a furnace;
- it must be bulky in order to avoid deforming excessively under load, since such deformation can in turn cause the supported parts to become deformed, requiring them to be rectified subsequently and consequently losing thickness in the cemented layer;
- tooling that is bulky makes gas exchange more difficult and decreases loading efficiency, i.e. reduces the working fraction of the volume which it occupies by the parts to be treated;
- violent thermal shock can cause the metal to be deformed or to break; and
- the inevitable variations in dimensions that are of thermal origin make it impossible for the operations of loading and unloading parts and of handling the tooling to be robotized because of the unacceptable lack of accuracy in positioning.

It is already known, in particular from document EP 0 518 746-A to use a thermostructural composite material instead of a metal when making the sole plates of heat treatment furnaces. A plurality of sole plates can be provided and spaced apart from one another by spacers likewise made out of thermostructural composite material. The composite material used is a carbon/carbon (C/C) composite material or a ceramic matrix composite (CMC) material.

Nevertheless, that known loading device is poorly adapted to achieving optimum loading, of the kind that can be desired when a relatively large number of identical parts are to be treated. In addition, that device does not lend itself to robotization of the operations of loading and unloading the parts.

OBJECT AND BRIEF SUMMARY OF THE INVENTION

An object of the present invention is to remedy the above-mentioned drawbacks of prior art devices, and to this end the invention provides a rack made essentially out of thermostructural composite material and comprising: a baseplate; a partition extending upwards from the baseplate and comprising, for example, uprights with cross-members extending therebetween; and a plurality of support arms fixed to the partition and extending substantially horizontally therefrom to their ends which are free, the arms being disposed in substantially symmetrical manner on either side of the partition such that parts for treatment can be supported cantilevered out on said arms.

Because it is made of thermostructural composite material and because it has horizontal arms with free ends, the rack provides the positioning and accessibility accuracy required for robotizing the operations of loading and unloading the parts to be treated. Thermostructural composite materials such as C/C and CMC composites are characterized by their dimensional stability and by their bending strength, thus making it possible to load the parts in a cantilevered-out position.

In addition, such a rack can be made to be lightweight and open-structured, while providing a large amount of filling capacity. It is therefore easy to handle, provides great capacity for exchange with the parts to be treated, in particular during cementation or quenching operations, and presents high loading efficiency.

In addition, since the arms extend substantially symmetrically on both sides of the partition, loading can be balanced.

Furthermore, its structure is suitable for modular construction, making it easy from standard basic elements to adapt racks for parts of different dimensions and for different heat treatment installations.

According to a feature of the rack, pegs can be mounted on the support arms to mark locations for the parts to be treated. The parts can then be threaded or hooked onto the support arms if the parts have a through passage, or they can be suspended by resting on two adjacent arms.

BRIEF DESCRIPTION OF THE DRAWINGS

The invention will be better understood on reading the following description given by way of non-limiting indication and with reference to the accompanying drawings, in which.

DETAILED DESCRIPTION OF EMBODIMENTS

In the description below, reference is made to racks for metal parts for cementation. The invention is not limited to such an application and, more generally, covers carrying parts, whether made of metal or not, that are to be subjected to heat treatment.

Figure 1:
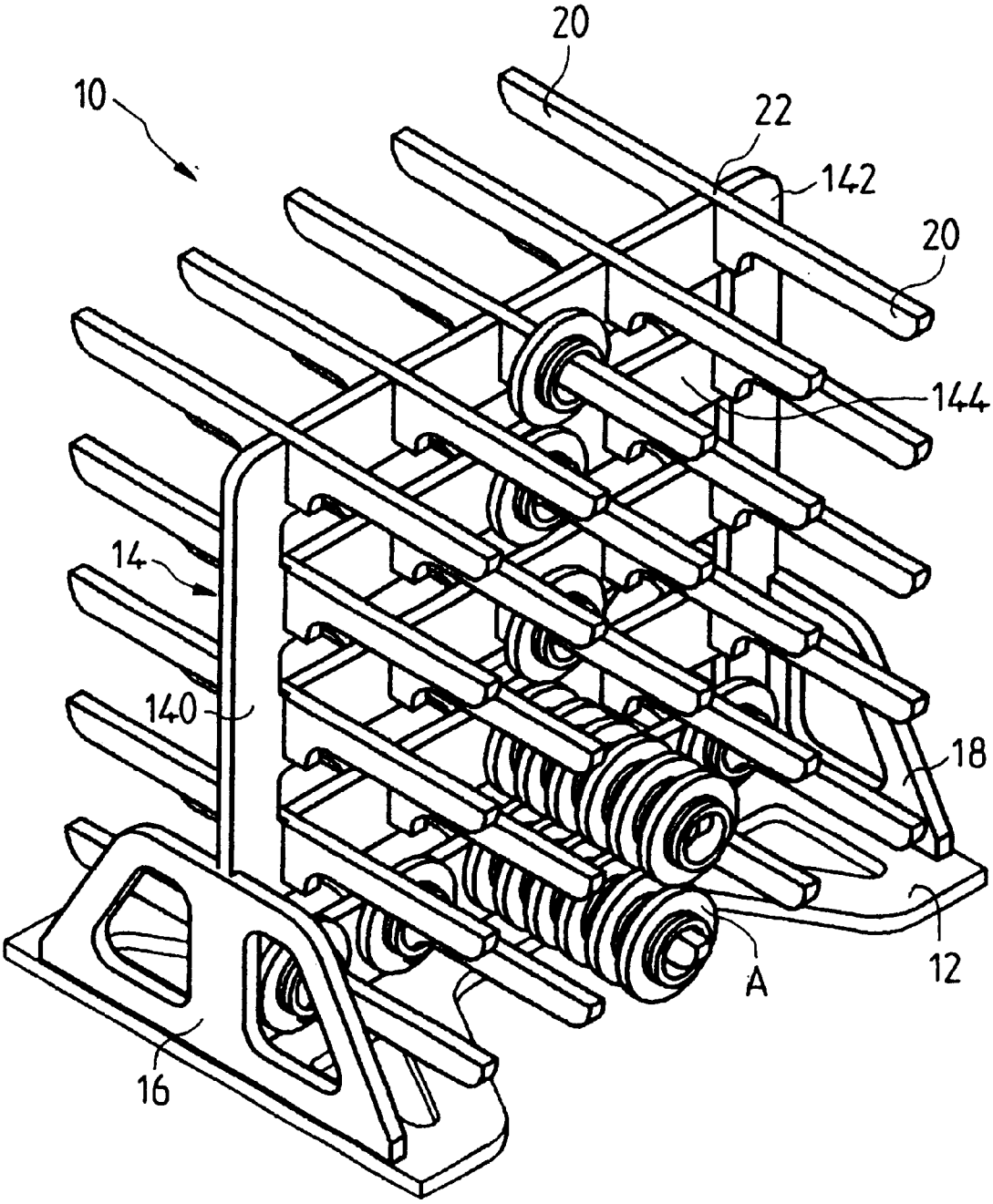
FIG. 1 is a diagrammatic perspective view of a first embodiment of a rack of the invention.

The rack 10 shown in FIG. 1 is intended specifically for supporting annular parts A such as gears for gear boxes. Only a few parts A are shown in FIG. 1.

The rack comprises (FIGS. 1 and 2) a support structure essentially formed by a baseplate 12, a vertical partition 14 supported by the baseplate 12 in the middle thereof, lateral reinforcing gussets 16 and 18, and horizontal support arms 20. The central partition 14 comprises lateral uprights 140, 142 with horizontal cross-bars 144 extending between them. The support arms 20 are constituted by bars 22 whose central portions are supported by the cross-bars 144. The bars 22 extend on either side of the partition 14 so that each forms two arms in alignment and of the same dimensions. At their ends remote from the partition 14, the arms 20 are free.

In a variant, the horizontal support arms 20 could be screwed to the partition 14 on either side thereof. The arms are mounted substantially symmetrically about the mid-vertical plane of the partition. This means that the arms are of substantially the same dimensions and in the same number on both sides of the partition, but not necessarily aligned in pairs.

The above elements constituting the structure of the rack are made out of thermostructural composite material.

Suitable composite materials are carbon/carbon (C/C) composites and ceramic matrix composite (CMC) materials. C/C composites are obtained by making a fiber preform out of carbon fibers and densifying the preform by forming a carbon matrix in the pores thereof. The carbon matrix can be obtained by a liquid method, i.e. by impregnating the preform with a liquid composition (such as a resin) that is a carbon precursor, and by applying heat treatment to transform the precursor into carbon,-or by a gas method, i.e. chemical vapor infiltration. CMCs are obtained by making a fiber preform out of refractory fibers, e.g. carbon fibers or ceramic fibers, and densifying the preform to form a ceramic matrix within its pores. In well-known manner, the ceramic matrix, e.g. of silicon carbide (SiC) can be obtained by a liquid method or by chemical vapor infiltration.

An advantage of thermostructural composite materials lies in their excellent mechanical properties, in particular their bending strength.

Consequently, it is possible to support the annular parts A by threading them onto the arms 20 from the free ends thereof, with each part A resting in a cantileveredout position, and without causing the arms to bend. is Advantageously, the load as a whole is kept in balance by distributing the parts equally on both sides of the partition 14.

Another advantage of thermostructural composite materials lies in their great dimensional stability, even when exposed to large variations of temperature. This makes it possible for the support arms 20 to conserve practically invariable position references and thus to have the precision required for robotizing loading and unloading operations. The way in which the parts A are supported on the arms 20 has the further benefit of making such robotization easy.

Making the rack with arms 20 that extend on either side of the partition 14 in substantially symmetrical manner thereabout also makes it possible to perform loading and unloading simultaneously and symmetrically on both sides of the partition. This leads to a significant saving of time when performing such operations.

It will be observed that the parts A can be placed on the arms 20 side by side or in predetermined locations, with such locations being marked, for example, by notches formed in the arms.

Figure 2:
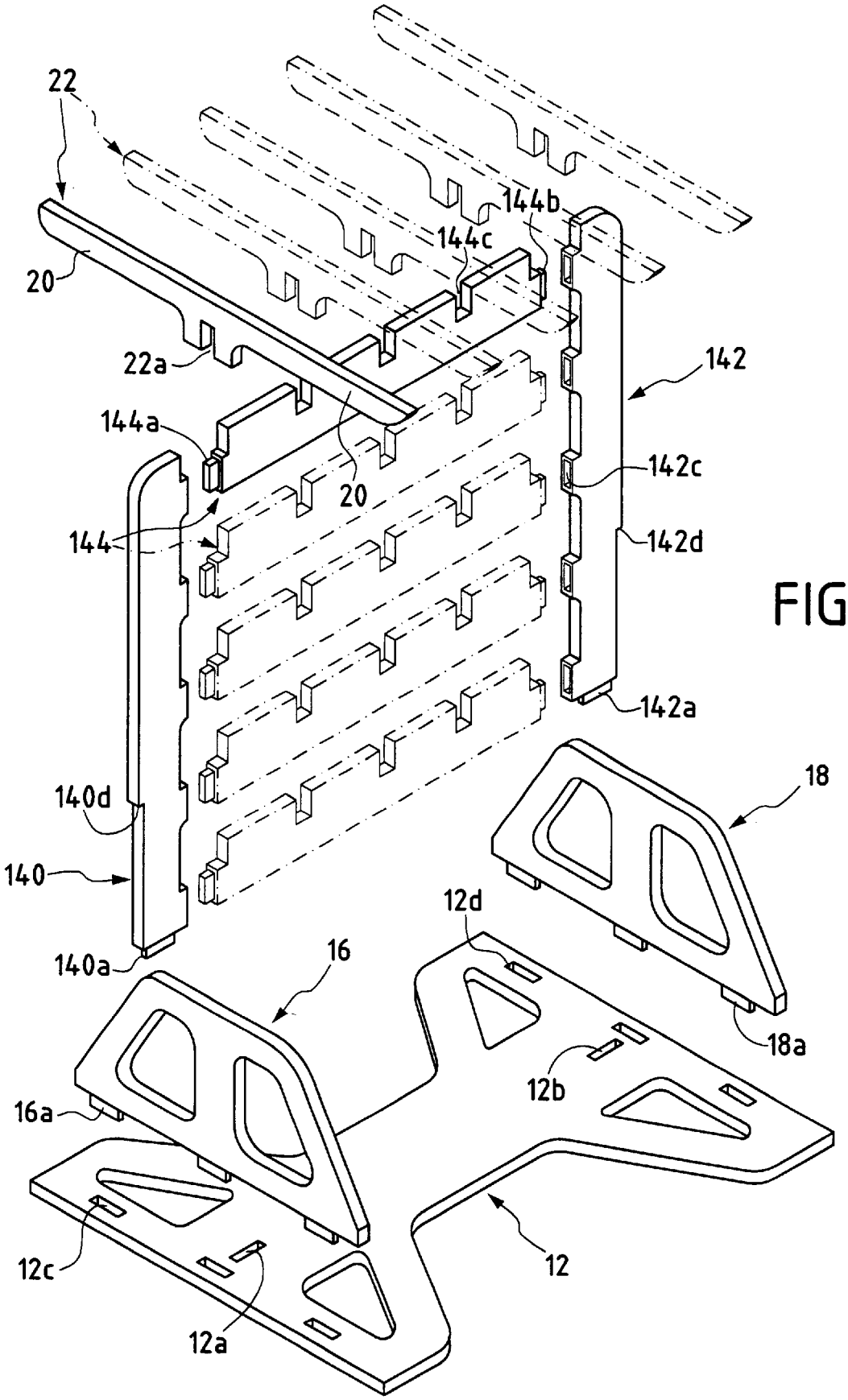
FIG. 2 is an exploded view showing some of the elements making up the FIG. 1 rack prior to being assembled together.

As can be seen more particularly in FIG. 2, the uprights 140, 142 have end portions 140*a*, 142*a* which engage in corresponding housings 12*a*, 12*b* formed in the baseplate 12, while the cross-bars 144 have end portions 144*a*, 144*b* which engage in housings such as 142*c* formed in the uprights 140, 142. Such housings 142*c* can be provided at regular intervals along the uprights 140, 142 so as to enable the cross-bars 144 to be mounted at a determined pitch as a function of the size of the parts A in the vertical direction. The gussets 16, 18 have tenons 16*a*, 18*a* along their bottom edges which are engaged in corresponding housings 12*c*, 12*d* formed in the baseplate 12. The uprights 140, 142 engage the gussets 16, 18 via setbacks 140*d*, 142*d* formed in their outside edges.

Each bar 22 has a notch 22*a* in its central portion for co-operating with the notch 144*c* formed in a crossbar 144 so as to engage the bar on the cross-bar. Each cross-bar has notches 144*c* distributed along its length so as to enable the bars 22 to be mounted on a given cross-bar at a pitch which is determined by the size of the parts A in a horizontal direction.

The modular nature of the rack can be extended by making each upright 140, 142 not as a single piece, but as a plurality of pieces that are assembled end to end.

In a variant, the uprights 140, 142 and the crossbars 144 of the partition 14 can be made as a single piece, e.g. by machining a plate of thermostructural composite material.

FIG. 1 shows that the rack possesses very great filling capacity while nevertheless presenting a structure that is lightweight and open, and holes can be formed in the structural elements such as the baseplate 12 and the gussets 16, 18. It is thus easy to handle a complete rack. Furthermore, when the heat treatment includes allowing a gas to diffuse in contact with the parts, gas exchange with the parts is facilitated.

Figure 3:
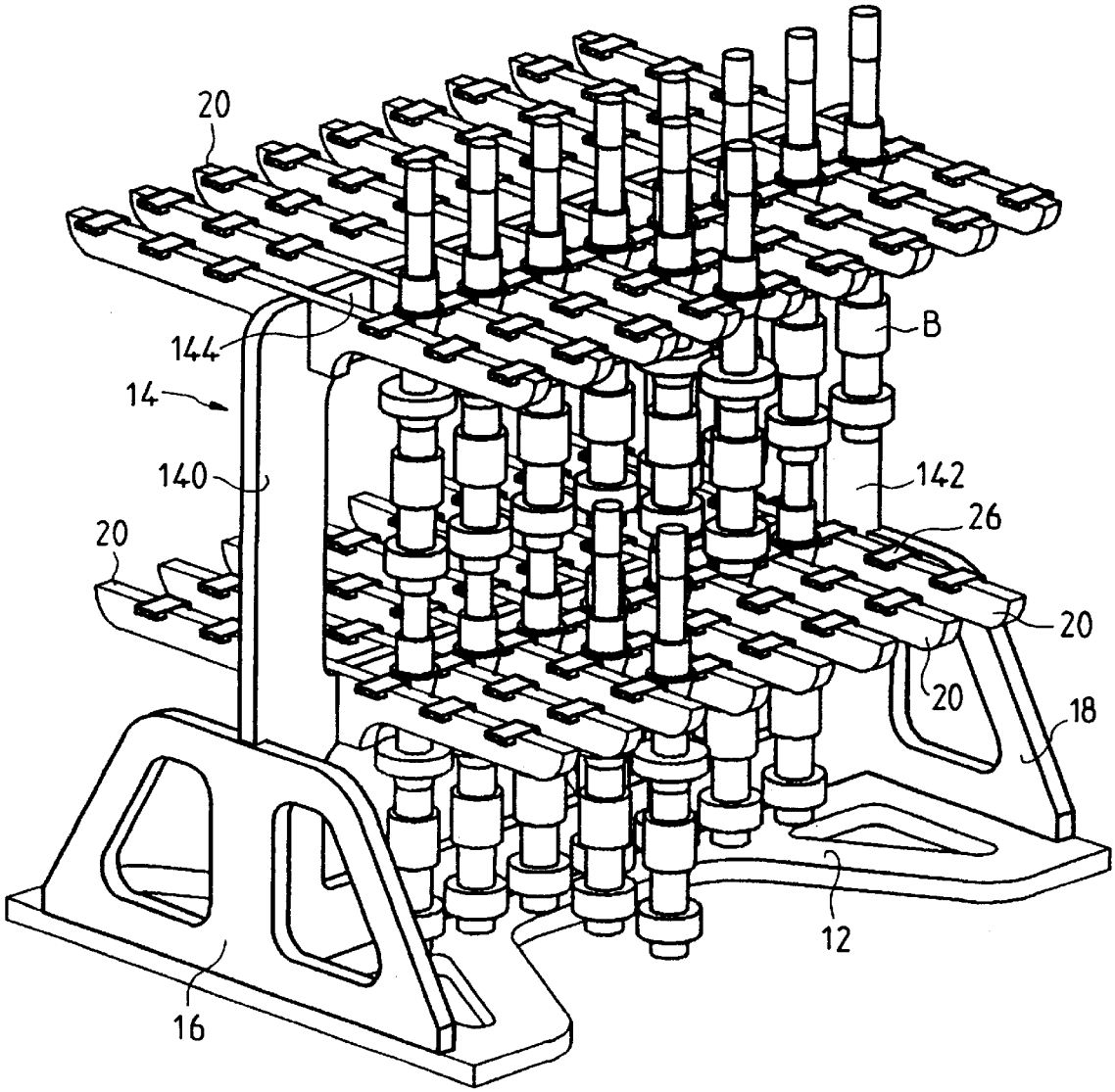
FIG. 3 is a diagrammatic perspective view of a second embodiment of a rack of the invention.

The rack of FIG. 3 differs from that of FIG. 1 in that it is designed more particularly for supporting parts that are solid and elongate, such as shafts B which are disposed vertically (in FIG. 3, the parts B are shown on one side only of the rack). In addition, the locations for the parts B are marked by pegs 26 on which the parts rest.

The rack is built in identical manner to that shown in FIG. 1, with the baseplate 12 supporting the central partition 14 on which the bars 22 that form the horizontal arms 20 with free ends are mounted. The number of cross-bars 144 in the central partition, between the uprights 140, 142, and the spacing between the cross-bars are determined as a function of the vertical size of the parts B. The spacing between the arms 20 is determined as a function of the horizontal size of the parts B.

It will be observed that each part B rests via a shoulder on two pegs 26 carried by adjacent arms 20 at the same locations along said arms, each part being inserted for loading purposes in the gap between two arms. The pegs 26 are distributed along each arm at a spacing that is a function of the horizontal size of the parts B in the direction parallel to the arms 20.

The pegs 26 can be made out of a thermostructural composite material, e.g. the same material as the other elements of the rack, or they can be made of a refractory metal material. The pegs 26 can be in the form of clips that are merely placed with a small amount of force on the arms 20, with no adhesive being required.

Although FIGS. 1 and 3 show racks each supporting parts that are all identical, it is naturally possible to put parts of different shapes on a single rack.

What is claimed is:

1. A rack for supporting parts to be subjected to heat treatment, said rack comprising:

a baseplate;

a partition extending above the baseplate; and a plurality of support arms fixed to the partition and extending substantially horizontally from the partition to the ends of the arms which are free, the arms being disposed in substantially symmetrical manner relative to the partition, and said baseplate, said partition, and said plurality of support arms being made out of thermostructural composite material;

thereby enabling parts to be treated to be supported in a cantilevered-out position on said arms, and enabling the parts to be loaded and unloaded in symmetrical manner on both sides of the partition.

2. A rack according to claim 1, characterized in that it further includes pegs mounted on the arms to mark the locations for supporting parts (B).

3. A rack according to claim 1, characterized in that the partition has uprights between which cross-bars extend.

4. A rack according to claim 1, characterized in that the support arms are formed by bars each extending on either side of the partition to form two opposite arms.

5. A rack according to claim 3, characterized in that the bars are interfitted on the cross-bars of the partition.

6. A rack according to claim 2, characterized in that the partition has uprights between which cross-bars extend.

7. A rack according to claim 2, characterized in that the support arms are formed by bars each extending on either side of the partition to form two opposite arms.

8. A rack according to claim 3, characterized in that the support arms are formed by bars each extending on either side of the partition to form two opposite arms.

9. A rack according to claim 4, characterized in that the bars are interfitted on the cross-bars of the partition.

* * * * *

UNITED STATES PATENT AND TRADEMARK OFFICE

CERTIFICATE OF CORRECTION

PATENT NO. : 6,401,941 B1 
DATED : June 11, 2002
INVENTOR(S) : Jean-Pierre Maumus It is certified that error appears in the above-identified patent and that said Letters Patent is hereby corrected as shown below:

Column 3,
Line 23, "cantileveredout" should read -- cantilevered-out --; and
Line 24, delete "is".

Signed and Sealed this

Eighteenth Day of November, 2003

JAMES E. ROGAN
*Director of the United States Patent and Trademark Office*